United States Patent [19]

Osterwise

[11] Patent Number: 4,944,560

[45] Date of Patent: Jul. 31, 1990

[54] MINER CUTTING BIT HOLDING APPARATUS

[75] Inventor: George A. Osterwise, Franklin, Pa.

[73] Assignee: Joy Technologies Inc., Pittsburgh, Pa.

[21] Appl. No.: 366,559

[22] Filed: Jun. 15, 1989

[51] Int. Cl.[5] ..... E21B 35/18

[52] U.S. Cl. ..... 299/91; 299/93

[58] Field of Search ..... 299/91, 92, 93

[56] References Cited

U.S. PATENT DOCUMENTS

| | | | |
|---|---|---|---|
| 4,275,929 | 6/1981 | Krekeler | 299/91 |
| 4,693,518 | 9/1987 | Sulosky et al. | 299/93 |
| 4,828,327 | 5/1989 | Wechner | 299/93 X |

*Primary Examiner*—William P. Neuder

*Attorney, Agent, or Firm*—Kirkpatrick & Lockhart

[57] ABSTRACT

A bit shoulder for attachment of a mining cutting bit to a driven element is provided. The bit holder includes a base member which may be attached to the driven element. The bit holder is provided with a forward body member having forward and rearward surfaces and a bore for receiving therethrough the extended shank of a cutting bit. A rearward member is also attached to the base member and includes an anvil portion having an anvil surface spaced from and facing the rearward surface. A reinforcement member is provided between the rearward member and the rearward surface to rigidify the bit holder.

8 Claims, 2 Drawing Sheets

MINER CUTTING BIT HOLDING APPARATUS

BACKGROUND OF THE INVENTION

1. Field of the Invention

The present invention relates to apparatus for holding a cutting bit used to cut earth, rock, pavement and the like and, in particular, to an improved unitary cutting bit holding apparatus.

2. Description of the Invention Background

In the materials field mining and in other fields in which a large volume of hard materials must be cut, it is typical to employ an apparatus which includes a vertically moveable horizontal axis cutting drum having cutting bits attached thereto. By virtue of the engagement of the cutting bits which are mounted on the rotating cutting drum with the surface to be cut, material is removed from such surface for further processing.

Due to the substantial forces generated during the cutting operations, the cutting bits must be securely mounted on the cutting drums, but must also be readily removable for replacement. In one prior art form of cutting bit holding apparatus, a cutting bit having an elongated cylindrical shank and a hard cutting tip at one end and an abutment surface at the other end is retained in a bit holder which is usually welded to the cutting drum. Such bit holder includes a body portion having a forward surface (as taken in the cutting direction) and a rearward surface. A shank receiving bore extends through the body and forms openings in the forward and rearward surfaces for passage of the shank of the cutting bit therethrough.

The bit holder has a rearward extension terminating in a free-standing anvil portion having an anvil surface. The rearward end of the cutter bit shank extends beyond the rear surface of the bit holder body portion. The abutment surface on the cutting bit is adapted to cooperate with the anvil surface on the anvil portion so as to determine the depth to which the cutting bit extends into the shank receiving bore and to limit its axial movement during cutting operations. In addition, a retaining ring is provided about the rearward portion of the cutting bit shank to prevent forward axial removal of the cutting bit.

However, Applicant has discovered serious shortcomings with the above-described cutting bit holder. For example, due to the forces imparted on the bit holder by the cutting bit during the cutting operation, such prior art bit holders have catastrophically failed at the juncture of the rearward extension portion and the body portion of the bit holder. Also, such prior art bit holders have catastrophically failed in the body portion thereof by separating longitudinally along the shank receiving bore.

As will be appreciated, such failures of bit holders are quite costly because the cutting apparatus must be removed from service in order that the remaining portion of the bit holder may be cut away from the cutting drum and a replacement bit holder accurately welded onto the cutting drum. In addition, when the body portion of the bit holder fails along the cutting bit receiving bore, the cutting bit is frequently lost and must also be replaced.

The subject invention is directed toward an improved cutting bit holder which overcomes, among others, the above-described problems with prior art bit holders and provides a bit holder which is must less prone to such catastrophic failures and the concomittant apparatus downtimes, while being capable of being manufactured at similar costs thereto.

SUMMARY OF THE INVENTION

In accordance with the present invention, there is provided a bit holder for attachment of a cutting bit to a cutting drum. The cutting bits which may be employed with the subject invention comprise an elongated shank having a hard cutting tip at one end thereof and an abutment surface at the other end. Optionally, a shoulder may be provided on the shank approximately midway between the abutment surface and the cutting tip.

The bit holder includes a base member which may be rigidly secured to the cutting drum. At the leading end of the bit holder there is provided a body member having a conical or cylindrical portion. Forward and rearward surfaces are provided on the body member in a direction perpendicular to the cutting direction. A bore is provided through the body member and forms openings in the forward and rearward surfaces to receive the shank of the cutting bit therethrough. Preferably, the shoulder on the shank of the cutting bit is in abutting relationship with the forward surface on the bit holder.

A rearward extension is attached to the base member and includes an anvil member having an anvil surface in facing relation to the abutment surface on the cutting bit. In addition, a reinforcing member extends between the rearward extension and the rearward surface of the body member to provide substantial structural rigidity to the bit holder. However, openings are provided on the sides of the trailing end of the cutting bit to allow for ease of removal thereof.

Accordingly, the present invention provides solutions to the aforementioned problems present with prior art cutting bit holders. As this invention provides a reinforcement member between the rearward extension and the body member, failures of the base member and/or of the body member are avoided. In addition, the openings on the sides of the bit holder allow access to the retaining ring on the cutting bit to permit its removal from the bit holder.

These and other details, objects and advantages of the invention will become apparent as the following description of the present preferred embodiment thereof proceeds.

BRIEF DESCRIPTION OF THE DRAWINGS

In the accompanying drawings, I have shown a present preferred embodiment of the invention wherein.

DETAILED DESCRIPTION OF THE PREFERRED EMBODIMENTS

Figure 4:
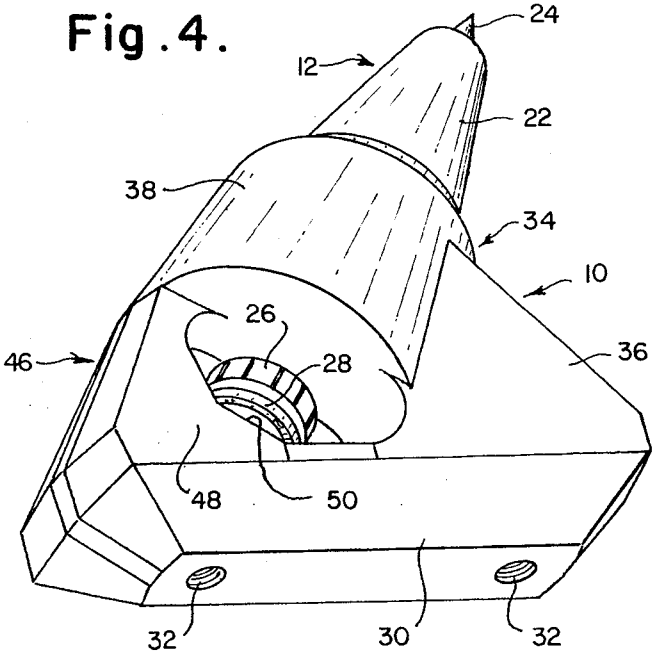
FIG. 4 is a perspective view of the bit holder according to the present invention showing the base member thereof in greater clarity.

Referring now to the drawings wherein the showings are for purposes of illustrating the present preferred embodiments of the invention only and not for purposes of limiting same, the figures show a cutting bit holder 10 for supporting a cutting bit 12 on a rotatable cutting drum 14 or other driven element.

Figure 1:
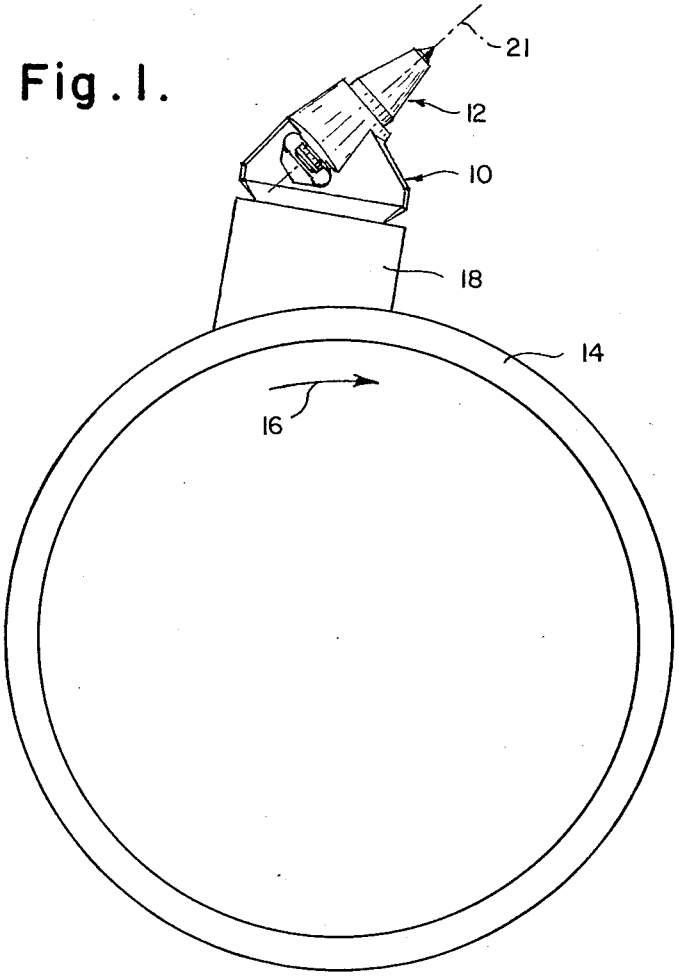
FIG. 1 is a side elevation view of the bit holder of the present invention attached to a cutting drum.
Figure 3:
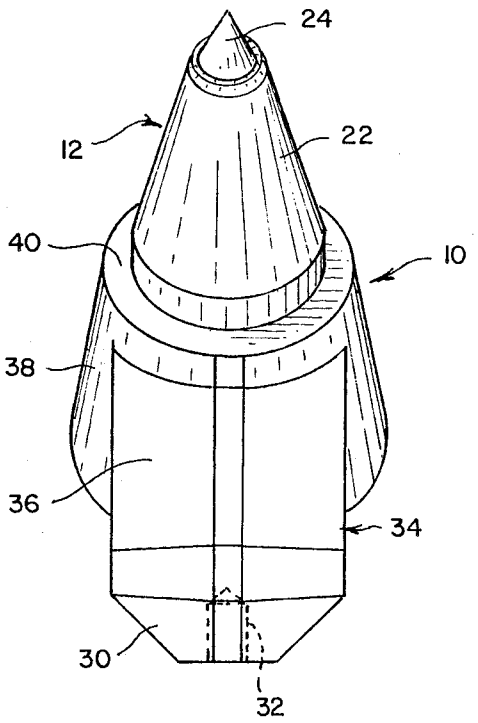
FIG. 3 is a front elevation view of the instant invention and a cutting bit.
Figure 2:
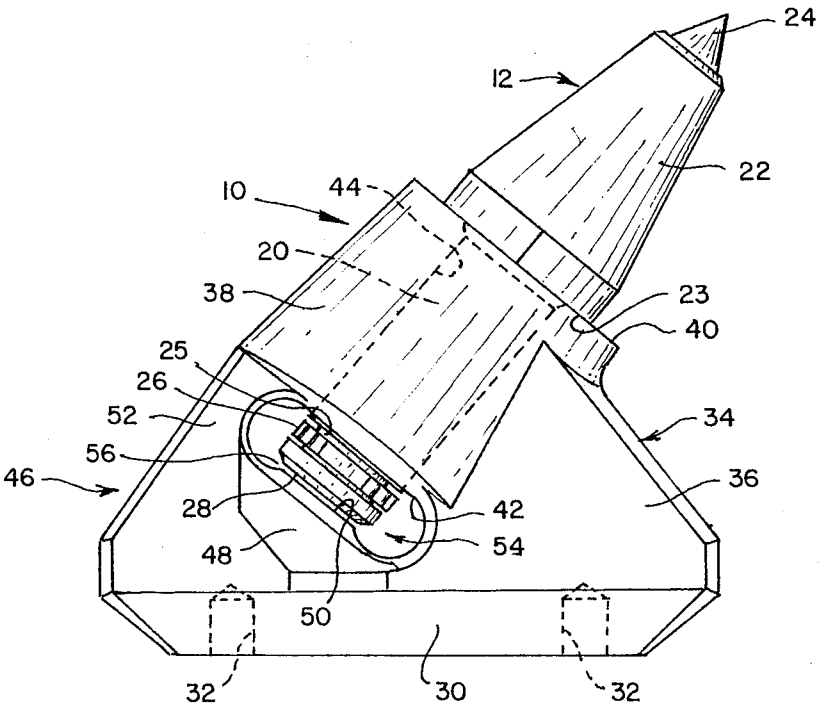
FIG. 2 is a side elevation view of the subject bit holder and a cutting bit.

More particularly and with reference to FIG. 1, there is shown a cutting bit holder 10 which is mounted on a cutting drum 14 which is rotatable in the direction shown by arrow 16. Specifically, bit holder 10 is mounted as by welding on a riser block 18 which is mounted, also as by welding to the cutting drum 14. However, it will be appreciated that the bit holder 10 may be mounted directly on the cutting drum 14.

The cutting bit 12 includes an elongated shank 20, which defines an axis 21, having at one end a conical nose 22 having a shoulder 23 and terminating in a hard cutting tip 24, the other end of cutting bit 12 is provided with an annular notch 25 for receiving a retaining ring 26 and terminates in an abutment surface 28.

The bit holder 10 includes a base member 30 which may be attached as by welding directly to the cutting drum 14 or, alternatively, to a riser block 18 mounted on the cutting drum 14. In either event, the base member 30 may include bores 32 which are normal to the attachment surface and which may receive alignment pins (not shown) extending from the attachment surface to ensure proper positioning of the base member 30. A body member, generally shown as 34, is attached to the forward (taken as facing in the cutting direction) portion of the base member 30. The body member 34 includes a leading member 36 and an upper member 38 which is preferably conical or cylindrical. The upper member 38 includes a forward surface 40 and a rearward surface 42, each as taken relative to the cutting direction circumscribed by cutting bit 12. A bore 44 is provided in upper member 38 to receive the shank 20 and terminates in holes in the forward and rearward surfaces 40 and 42, respectively. As such, the bore 44 serves to hold the cutting bit 12 in the preferred cutting orientation. In addition, the forward surface 40 serves as an abutment to the shoulder 23 while the rearward surface 42 serves as a stop to cooperate with the retaining ring 26 to prevent removal of cutting bit 12 from bore 44.

Attached to and extending from the rear portion of base member 30 is a rearward member, shown as 46. Rearward member 46 includes an anvil 48 having an anvil surface 50. Anvil surface 50 is preferably spaced from and in facing relation to rearward surface 42. In addition, a reinforcement member 52 is affixed between the rearward member 46 and the upper member 38 and is preferably secured to the rearward surface 42. In order to gain access to the rear portion of cutting bit 12 and the retaining ring 26, openings 54 are provided between the anvil surface 50 and the rearward surface 42.

As will be appreciated, when the cutting bit 12 is provided with a shoulder 23, the bit holder 10 and cutting bit 12 may be relatively so dimensioned that a small clearance space 56 may be provided between the abutment surface 28 and the anvil surface 50. In that case, upon use of the cutting bit 12 and bit holder 10, the clearance space may be diminished so that such surfaces become in contact. Alternatively, if the cutting bit 12 does not include a shoulder 23 to resist movement of the cutting bit 12 toward the anvil 48, the cutting bit 12 is normally retained within bit holder 10 with the abutment surface 28 in contact with the anvil surface 50 to counteract axial forces on the cutting bit 12 generated during cutting operations.

By virtue of the provision of the reinforcement member 52, the bit holder 10 affords significantly increased resistance to catastrophic failure as in the base member 30 or in the upper member 38.

It will be understood that various changes in the details, materials and arrangements of parts which have been herein described and illustrated in order to explain the nature of the invention may be made by those skilled in the art within the principle and scope of the invention as expressed in the appended claims.

What is claimed is:

1. Apparatus for attaching a cutting bit, which includes an elongated shank having a cutting tip secured to one end thereof and an abutment surface provided on the other end thereof, to a driven element so that said cutting bit is advanced in a cutting direction, comprising:

a. a base member adapted for attachment to said driven element;

b. a body member attached to said base member on the end thereof facing in the cutting direction, said body member having a first surface on the end thereof facing toward said cutting direction and a second surface on the opposite end thereof and a bore through said body member terminating in apertures in said first and said second surfaces and adapted to receive said shank to hold said cutting bit in a predetermined cutting orientation;

c. a rearward member attached to said base member on the end thereof facing away from said cutting direction, said rearward member having an anvil surface parallel to said abutment surface and disposed in spaced facing relation to said second surface;

d. a reinforcement member attached intermediate and permanently to said rearward member and said body member; and e. means for releasably retaining said shank in said bore.

2. Apparatus of claim 1 further comprising openings in said bit holder adjacent to said anvil surface to allow access to the other end of said cutting bit.

3. Apparatus of claim 2 in which said base member further comprises alignment bores which may receive alignment pins provided on said driven element to align said base member relative thereto.

4. Apparatus of claim 2 further comprising a riser block for attachment to said driven element and to which said base member may be secured.

5. Apparatus for attaching a cutting bit, which includes an elongated shank having a cutting member provided on one end thereof which has a shoulder area of increased radius and a cutting tip, said shank having an abutment surface provided on the other end thereof, to a driven element so that said cutting bit is advanced in a cutting direction, comprising:

a. a base member adapted for attachment to said driven element;

b. a body member attached to said base member on the end thereof facing in the cutting direction, said body member having a first surface on the end thereof facing toward said cutting direction and adapted to contact said shoulder area and a second surface on the opposite end thereof and a bore through said body member terminating in apertures in said first and second surfaces and adapted to receive said shank to hold said cutting bit in a predetermined cutting orientation;

c. a rearward member attached to said base member on the end thereof facing away from said cutting direction, said rearward member having an anvil surface parallel to said abutment surface and disposed in spaced facing relation to said second surface;

d. a reinforcement member attached intermediate and permanently to said rearward member and said body member; and e. means for releasably retaining said shank in said bore.

6. Apparatus of claim 5 further comprising openings in said bit holder adjacent to said anvil surface to allow access to the other end of said cutting bit.

7. Apparatus of claim 6 in which said base member further comprises alignment bores which may receive alignment pins provided on said driven element to align said base member relative thereto.

8. Apparatus of claim 6 further comprising a riser block for attachment to said driven element and to which said base member may be secured.

* * * * *

UNITED STATES PATENT AND TRADEMARK OFFICE

CERTIFICATE OF CORRECTION

PATENT NO. : 4,944,560

DATED : July 31, 1990

INVENTOR(S) : George A. Osterwise

It is certified that error appears in the above-identified patent and that said Letters Patent is hereby corrected as shown below:

Under ABSTRACT, delete "shoulder" and substitute therefor --holder--.

Signed and Sealed this

Twenty-third Day of April, 1991

*Attest:*

HARRY F. MANBECK, JR.

*Attesting Officer*

*Commissioner of Patents and Trademarks*

US004944560B1

REEXAMINATION CERTIFICATE (2205th)

United States Patent [19]

Osterwise

[11] B1 4,944,560

[45] Certificate Issued Jan. 25, 1994

[54] MINER CUTTING BIT HOLDING APPARATUS

[75] Inventor: George A. Osterwise, Franklin, Pa.

[73] Assignee: Joy Technologies Inc., Pittsburgh, Pa.

Reexamination Request:
No. 90/002,740, Jun. 3, 1992

Reexamination Certificate for:

| | |
|---|---|
| Patent No.: | **4,944,560** |
| Issued: | **Jul. 31, 1990** |
| Appl. No.: | **366,559** |
| Filed: | **Jun. 15, 1989** |

Certificate of Correction issued Apr. 23, 1991.

[51] Int. Cl.[5] ..... E21B 10/46
[52] U.S. Cl. ..... 299/91; 299/93
[58] Field of Search ..... 299/91, 92, 93

[56] References Cited

U.S. PATENT DOCUMENTS

| | | | |
|---|---|---|---|
| 3,554,605 | 1/1971 | Elders | 299/86 |
| 4,068,897 | 1/1978 | Amoroso | 299/91 |
| 4,337,980 | 7/1982 | Krekeler | 299/91 |
| 4,342,486 | 8/1982 | O'Neill | 299/86 |
| 4,844,550 | 7/1989 | Beebe | 299/92 |

*Primary Examiner*—William P. Neuder

[57] ABSTRACT

A bit holder for attachment of a mining cutting bit to a driven element is provided. The bit holder includes a base member which may be attached to the driven element. The bit holder is provided with a forward body member having forward and rearward surfaces and a bore for receiving therethrough the extended shank of a cutting bit. A rearward member is also attached to the base member and includes an anvil portion having an anvil surface spaced from and facing the rearward surface. A reinforcement member is provided between the rearward member and the rearward surface to rigidify the bit holder.

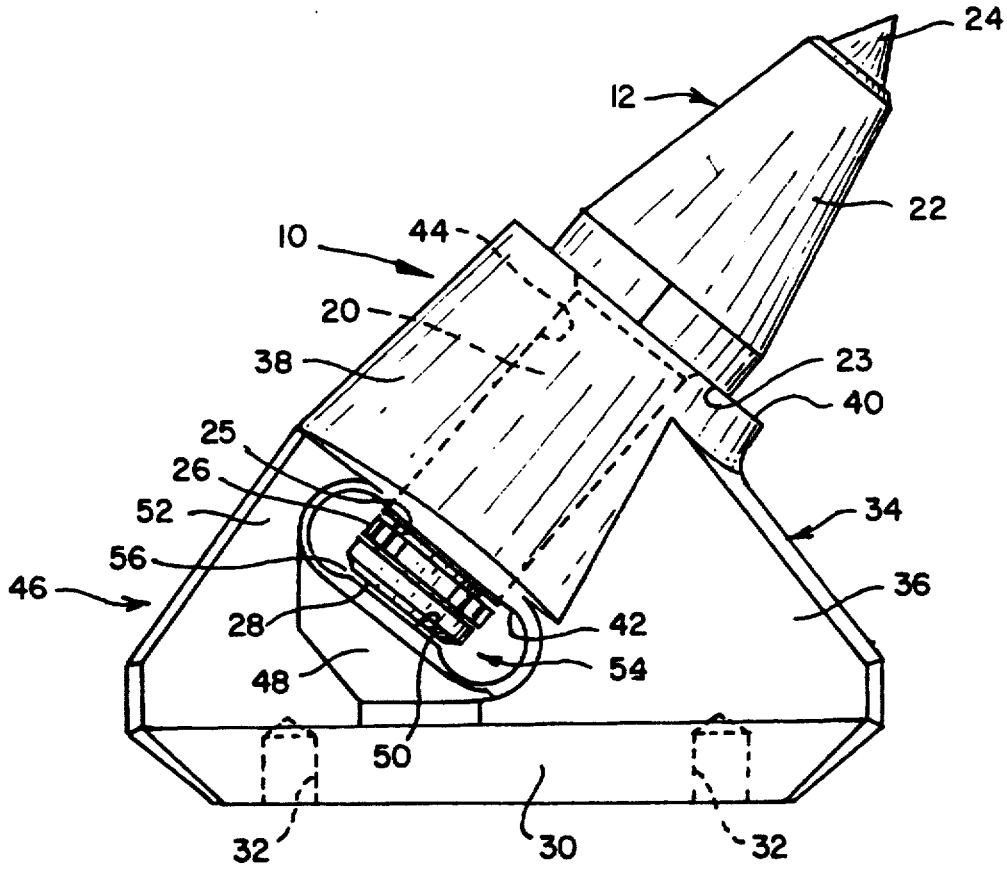

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 5 are determined to be patentable as amended.

Claims 2–4 and 6–8, dependent on an amended claim, are determined to be patentable.

1. Apparatus for attaching a cutting bit, which includes an elongated shank having a cutting tip secured to one end thereof and an abutment surface provided on the other end thereof, to a driven element so that said cutting bit is advanced in a cutting direction, comprising:

a. a base member adapted for attachment to said driven element;

b. a body member attached to said base member on the end thereof facing in the cutting direction, said body member having a first surface on the end thereof facing toward said cutting direction and a second surface on the opposite end thereof and a bore through said body member terminating in apertures in said first and said second surfaces and adapted to receive said shank to hold said cutting bit in a predetermined cutting orientation;

c. a rearward member attached to said base member on the end thereof facing away from said cutting direction, said rearward member having an anvil surface parallel to said abutment surface and disposed in spaced facing relation to said second surface, *and said abutment surface capable of coming into contact in normal use with said anvil surface;* d. a reinforcement member attached intermediate and permanently to said rearward member and said body member; and e. means for releasably retaining said shank in said bore.

5. Apparatus for attaching a cutting bit, which includes an elongated shank having a cutting member provided on one end thereof which has a shoulder area of increased radius and a cutting tip, said shank having an abutment surface provided on the other end thereof, to a driven element so that said cutting bit is advanced in a cutting direction, comprising:

a. a base member adapted for attachment to said driven element;

b. a body member attached to said base member on the end thereof facing in the cutting direction, said body member having a first surface on the end thereof facing toward said cutting direction and adapted to contact said shoulder area and a second surface on the opposite end thereof and a bore through said body member terminating in apertures in said first and second surfaces and adapted to receive said shank to hold said cutting bit in a predetermined cutting orientation;

c. a rearward member attached to said base member on the end thereof facing away from said cutting direction, said rearward member having an anvil surface parallel to said abutment surface and disposed in spaced facing relation to said second surface, *and said abutment surface capable of coming into contact in normal use with said anvil surface;* d. a reinforcement member attached intermediate and permanently to said rearward member and said body member; and e. means for releasably retaining said shank in said bore.

* * * * *